United States Patent [19]

Albrile

[11] 4,371,275

[45] Feb. 1, 1983

[54] SELECTOR SYSTEM FOR A SINGLE TYPE CARRIER IN TYPEWRITERS AND SIMILAR PRINTING MACHINES

[75] Inventor: Walter Albrile, Turin, Italy

[73] Assignee: Ing. C. Olivetti & C., S.p.A., Ivrea, Italy

[21] Appl. No.: 263,100

[22] Filed: May 12, 1981

[30] Foreign Application Priority Data

Dec. 28, 1979 [IT] Italy ..... 69487 A/79

[51] Int. Cl.[3] ..... B41J 1/60

[52] U.S. Cl. ..... 400/161.3; 400/164.2

[58] Field of Search ..... 400/161.2, 161.3, 161.4, 400/164.2

[56] References Cited

U.S. PATENT DOCUMENTS 3,957,149 5/1976 Salto ..... 400/164.2 X 4,067,429 1/1978 Salto et al. ..... 400/161.3 X

*Primary Examiner*—Paul T. Sewell

*Assistant Examiner*—Daniel J. Roock

*Attorney, Agent, or Firm*—Edward F. McKie, Jr.

[57] ABSTRACT

A selector system for a typewriter of the single type carrier kind, in which a series of stop members are selectively positionable in order to cooperate with two selector levers in such a manner as to effect the variable displacement of the type carrier for the selection of the character which is to be printed. A control member releases the selector levers for their operation by driving forces and comprises a cyclic resetting member which returns the selector levers to their position of rest against the action of the driving forces on completion of the typing of the character selected. A shift device for the type carrier comprises a cyclically operating drive mechanism adapted to operate a member kinematically connected to the type carrier for the selection of one of the two zones in which the characters are distributed.

14 Claims, 11 Drawing Figures

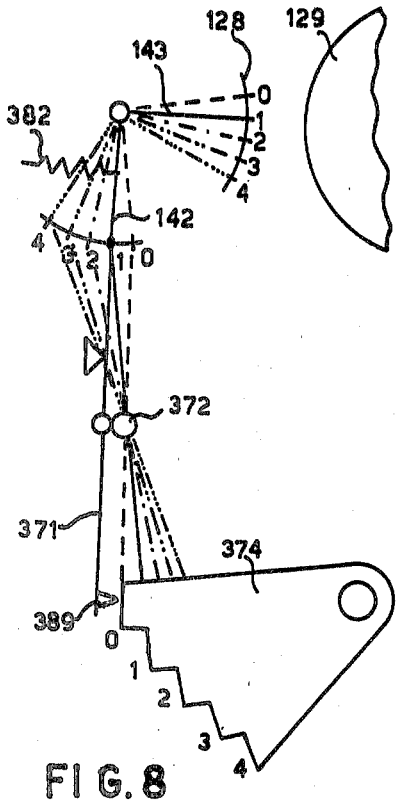
FIG. 8
| 343 | | 311 | 312 |
|---|---|---|---|
| 0 | | 0 | 0 |
| 1 | + | 0 | 1 |
| 2 | + | 0 | 2 |
| 3 | + | 0 | 3 |
| 4 | + | 0 | 4 |
| 4 | - | 4 | 0 |
| 3 | - | 3 | 0 |
| 2 | - | 2 | 0 |
| 1 | - | 1 | 0 |
FIG. 10
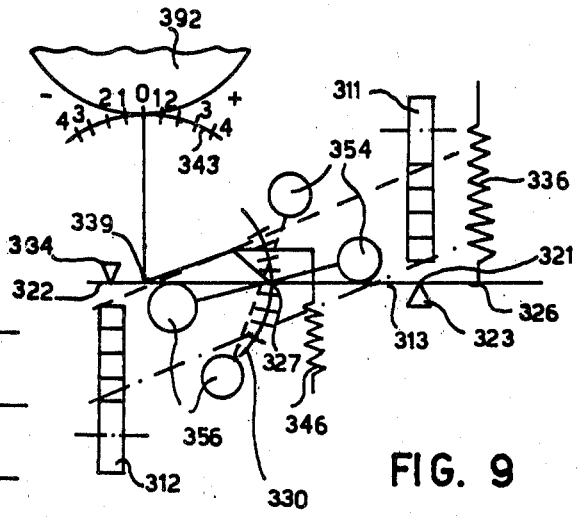
FIG. 9
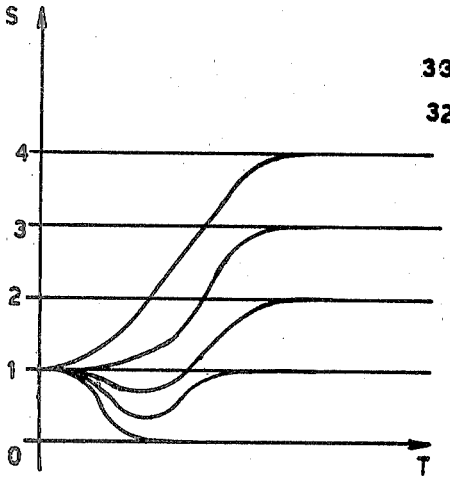
FIG. 11

SELECTOR SYSTEM FOR A SINGLE TYPE CARRIER IN TYPEWRITERS AND SIMILAR PRINTING MACHINES

BACKGROUND OF THE INVENTION

The present invention relates to a selector system for a single type carrier in typewriters or similar writing machines, which comprises a series of stop members which are selectively positionable and a selector lever adapted to cooperate with the positioned stop members and provided with two force application zones, namely an input zone receiving a driving force and an output zone which effects the variable displacement of the type carrier for the selection of the character which is to be typed.

A system of this type for typewriters is known in which the stop members are selectively positioned by code bars and in which a positive drive displaces one end of the selector lever for a constant stroke. The type carrier is urged in a first direction by a corresponding return spring and is connected to another end of the selector lever by means of an intermediate lever. The positioned stop member forms a new fulcrum for the selector lever, whose other end effects the variable displacement of the type carrier, for the selection of the character which is to be typed, against the action of its return spring. Another stop member can then reverse the direction of displacement of the type carrier, releasing the intermediate lever, which is then halted after a constant stroke made by the return spring. The type carrier is thus displaced in the second direction by a fixed quantity, from which is deducted the variable quantity obtainable from the positioned stops. This selector mechanism is accurate and fast. However, it uses a relatively large number of kinematic means and is therefore rather expensive.

SUMMARY OF THE INVENTION

The technical problem of the present invention is that of providing a selector system for a typewriter having a single type carrier, which is simple, reliable, and relatively inexpensive.

This technical problem is solved by the selector system according to the invention, which comprises a control member which releases the selector lever for its operation by the driving force, and wherein the stop members are subdivided into two groups and are positionable in pairs so as to act, alternately as fulcrums and stops for the selector lever, on fulcrum and stop zones of that lever which are mutually opposite in relation to one of the two force application zones, so as to bring about bidirectional, variable displacements of the output zone when the control member releases the selector lever.

The typewriter of the invention is provided with a type carrier head in which the characters are distributed in two different areas. According to another characteristic of the invention, the selector system provided comprises a first member kinematically connected to the head and a second member which normally lies outside the trajectory of the first member during the selection of a character of one area and on the other hand engages the second member in order to prepare the other area of the type carrier head for typing.

BRIEF DESCRIPTION OF THE DRAWING

The following description relates to a preferred embodiment of the invention given by way of example, without limitation, and with reference to the accompanying drawing, in which:

FIG. 8 is a diagrammatical view of the vertical selection of the system shown in FIG. 1;

FIG. 9 is a diagrammatical view of the horizontal selection of the system shown in FIG. 1;

FIG. 10 is a table of the horizontal selection shown in FIG. 9, and

FIG. 11 is a diagram of the movement of the head during the horizontal selection.

DESCRIPTION OF THE PREFERRED EMBODIMENT

Figure 1:
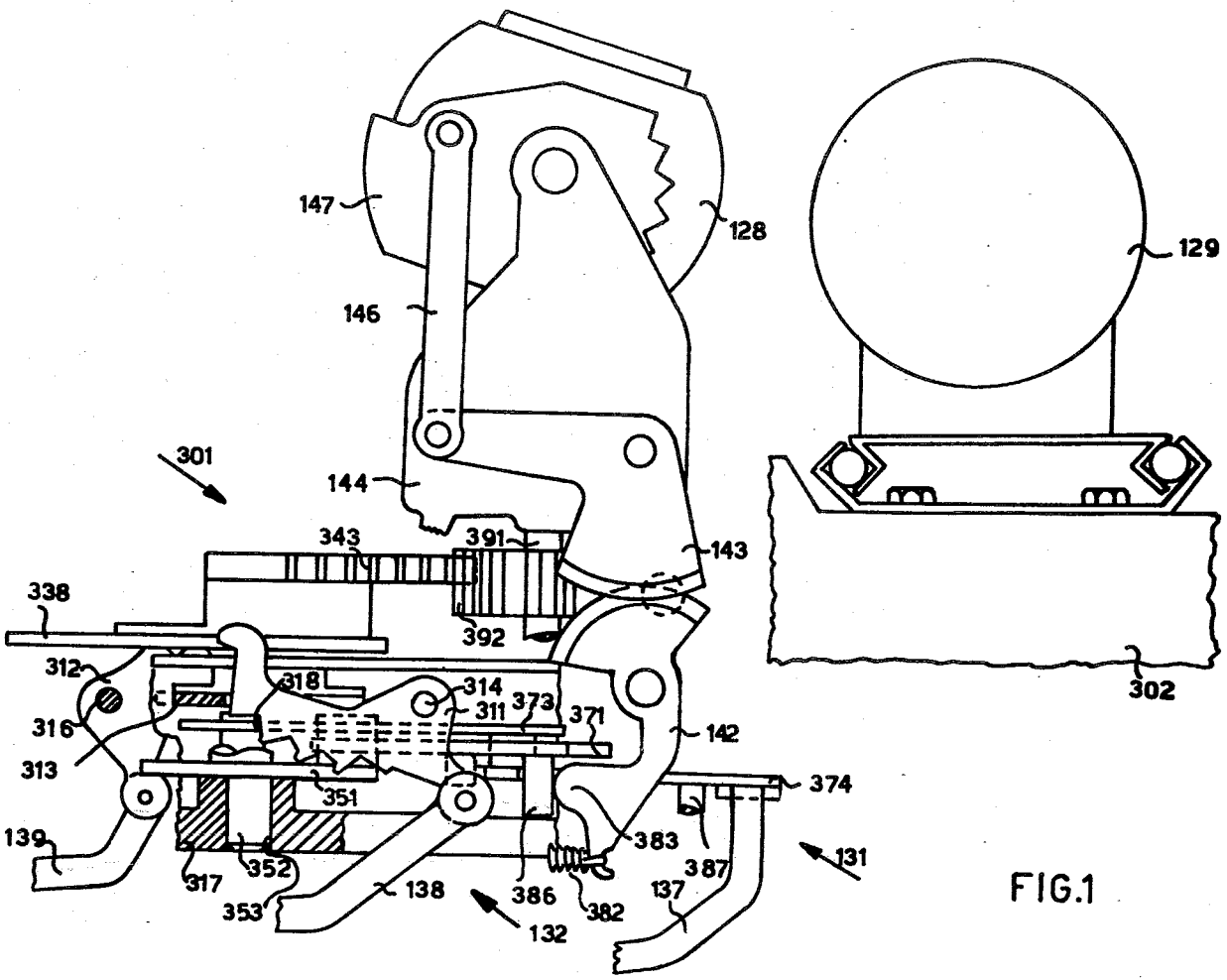
FIG. 1 is a partial longitudinal view of a selector system according to the invention.

Referring to FIG. 1, the selection system indicated generally by the reference 301 is applied to a typewriter having a paper carrier platen 129 adapted to move transversely relative to a frame 302 of the machine in a manner known per se.

The typewriter has a type carrier consisting of a head 128 substantially similar to that described in U.S. Pat. No. 3,957,149 assigned to Ing. C. Olivetti & C., S.p.A. The head 128 has its characters disposed in eighteen columns, which are distributed over five rows and to which the head 128 is substantially perpendicular. The nine columns disposed facing the platen 129 are centred in relation to the platen and normally carry a group of "lower case" characters, while the nine columns disposed oppositely carry a group of "upper case" characters. The head 128 is mounted in front of the platen 129 on a support 144 which is movable for the stroke.

For the selection of the character which is to be typed, the head 128 can be swivelled and tilted in relation to the support 144. A shift device designated 303 (FIG. 3) is adapted to be operated independently of the selector system 301 (FIG. 1), and causes the head 128 to be swivelled 180° (as will be described later on) in order to bring the "lower case" or "upper case" groups of characters in front of the platen 129.

Figure 7:
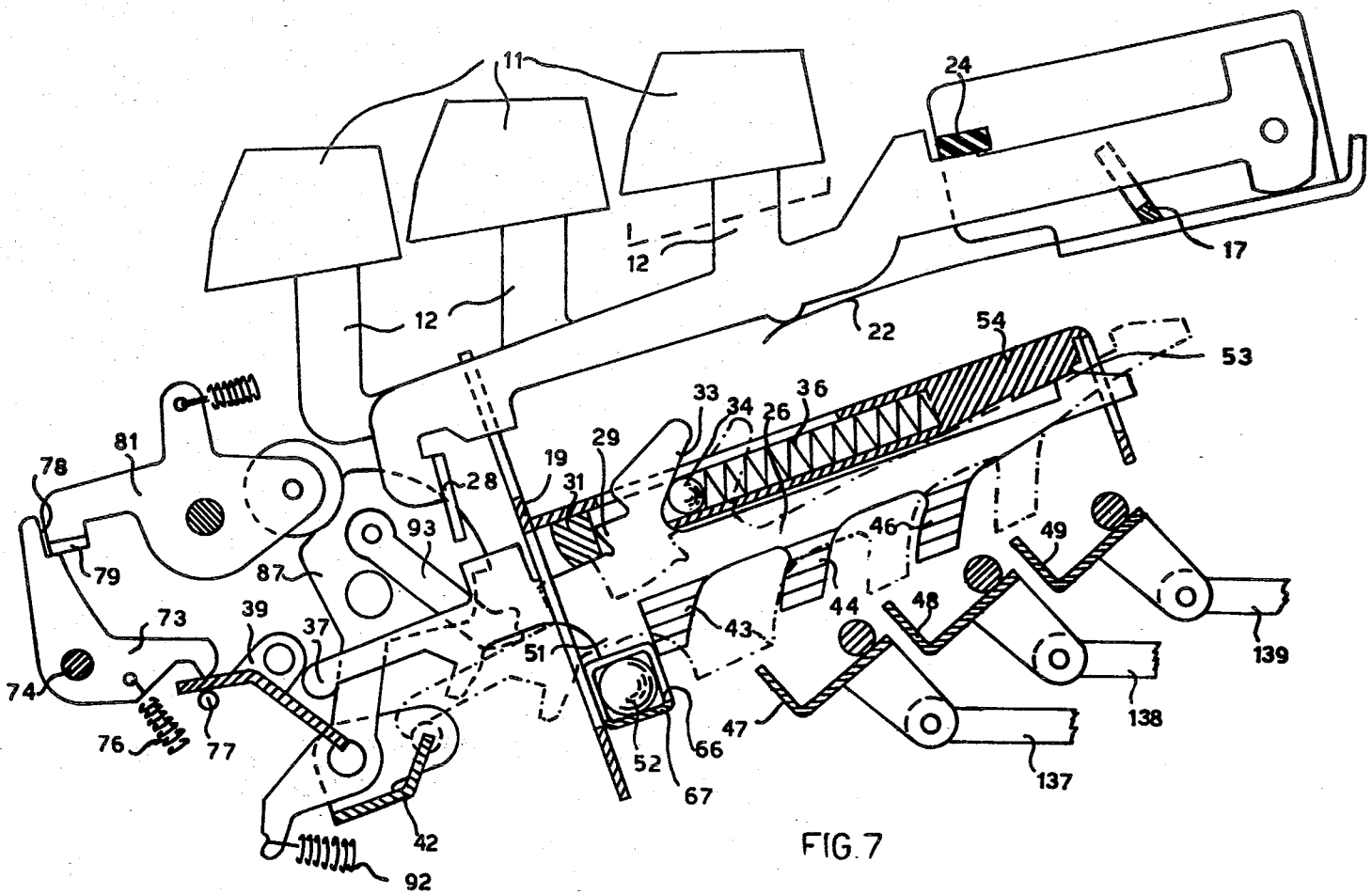
FIG. 7 is a partial longitudinal view of a keyboard of a typewriter having a single type carrier, which keyboard operates the system shown in FIG. 1.

In order to tilt and swivel the head 128, the selector system 301 is provided with a device for selecting the rows, which is given the general reference 131, and a device for selecting the columns, which is given the general reference 132. The row selector device 131 and the column selector device 132 are connected by means of tie rods 137, 138, and 139 to a group of code bars or probe members 47, 48, and 49 respectively (FIG. 7) adapted to cooperate with a group of steps or stops 43, 44, and 46 of a keyboard given the general reference 304.

The keyboard 304 comprises a series of keys 11 carried respectively by vertically movable key carrier levers 12 guided in slots 16 in a comb 17 of a comb plate 19. Each lever 12 is normally held by a respective leaf spring 22 in the position of rest against a rubber stop 24 and has a fin 28 adapted to cooperate with a shoulder 27 of a respective positioner composed of a plate 26 of elongated shape. Each positioner 26 has an inclined edge 33 acted on, through the medium of a ball 34, by a compression spring 36 which holds the positioner 26 at rest by an L-shaped shoulder 29 against a fixed stop 31 and by a shoulder 53 against the bottom edge of a support 54. In its position of rest each positioner 26 is guided by the bottom edge of a fin 51 in a slot 66 of a container 67 for balls 52 for the mutual locking of the keys 11.

Each positioner 26 has a front end 37 adapted to cooperate with a release frame 39 which through the action of a spring 76 and of a first release lever 73 is held locked against a fixed stop 77. A positioning spring 92 urges an operating lever 87 to turn in the anticlockwise direction together with a universal bar 42 adapted to engage the positioners 26 selected in the manner indicated in U.S. Pat. No. 4,027,763 assigned to Ing. C. Olivetti & C., S.p.A. The lever 87 urges a second release lever 81 to turn in the counterclockwise direction, but by means of its fin 79 the lever 81 remains held against an L-shaped shoulder 78 of the first release lever 73 and holds the universal bar 42 engaged.

Figure 4:
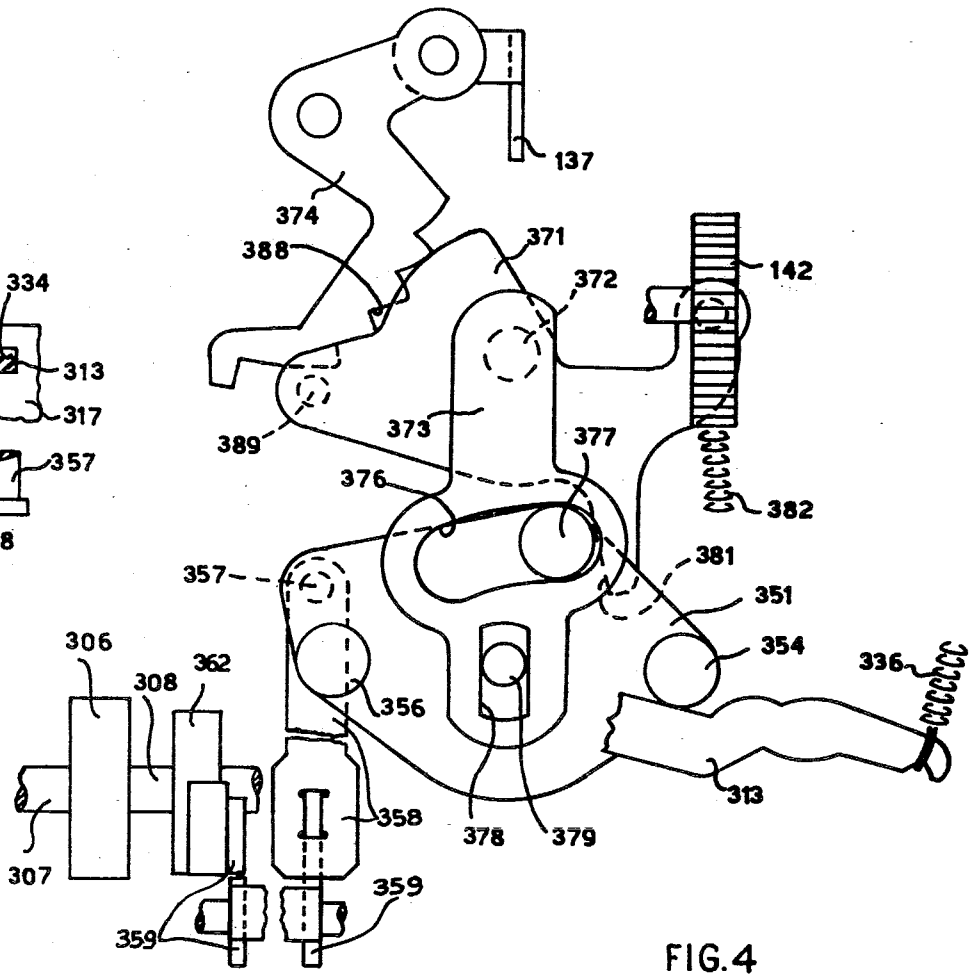
FIG. 4 is a partial plan view of other details of the system shown in FIG. 1.

Similarly to the arrangement described in the above-mentioned U.S. Pat. No. 4,027,763, the operating lever is connected to a starting clutch 306 (FIG. 4), which has a cyclic action, by means of a tie rod 93 (FIG. 7), which effects the closing of the clutch 306 (FIG. 4) on a drive shaft 307 of the machine, and the consequent rotation through 180° of a shaft 308 for carrying out the various type selection operations. In addition, a resetting device, not shown in the drawings, resets the operating lever 87 (FIG. 7) together with the universal bar 42 at the end of each positioning cycle, against the action of the spring 92.

In its lower part each positioner 26 is provided with three codified steps 43, 44, and 46 having five different heights. By means of these steps each positioner 26, when in its working position, is adapted to secure selectively three corresponding probe members consisting of bars 47, 48, and 49 in one of five different positions corresponding to a specific combination associated with the key 11 depressed. On the head 128 (FIG. 1) the stops 43 and the bar 47 (FIG. 7) select each of the five rows of characters, while in turn the stops 44 and 46 and the bars 48 and 49 select five of the nine columns of characters of the head 128.

The column selector device 132 (FIG. 1) comprises two stop members 311 and 312 and a selector lever 313. The stop members 311 and 312 each comprise a flight of steps 318, 319 having five steps of different heights and pivoted on a pin 314, 316 of a support 317 and connected to respective tie rods 138, 139. The steps 318 and 319 (FIG. 3) are disposed in front of two fulcrum and stop zones 321 and 322 of the selector lever 313, which zones are adapted to hold the selector lever 313 in one of nine different selection positions for the positioning of the columns on the head along a first coordinate.

Figure 2:
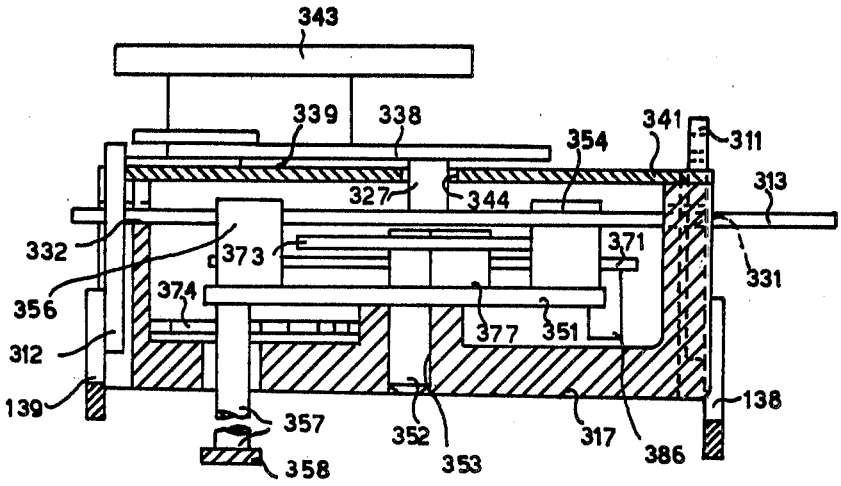
FIG. 2 is a partial front view of the system shown in FIG. 1.

The selector lever 313 is substantially rectilinear and has two shoulders 323 and 324 disposed on opposite edges to those of the zones 321 and 322, and also has an input zone 326 and an output zone or central zone 327 to which drive forces and resistant forces are respectively applied. The input zone 326 is disposed at one end of the lever outside the fulcrum and stop zones, while the output zone 327 is disposed in a part of the lever 313 lying between the two members 311 and 312 which are situated in mutually opposite zones in relation to a plane 328, which is shown in dash-dot lines and which passes through the output zone 327. The selector lever 313 is disposed between two slots 331 (FIG. 2) and 332 in the support 317 and is adapted to be held, by means of the shoulders 323 (FIG. 3) and 324, by a pair of fixed stops 333 and 334 of the support 317 (FIG. 2), which are disposed on opposite parts in relation to the stop members 311 (FIG. 3) and 312 at a short distance from the shoulders 323 and 324.

A drive spring 336 applied between the input zone 326 and a fixed stop 337 acts on the selector lever 313 as drive force. The output zone 327 of the selector lever 313 has a fixed fulcrum on an intermediate lever 338 adapted to turn on a pin 339 on a plate 341 (FIG. 2) of the support 317. The intermediate lever 338 is connected by means of a bistable spring 342 (FIG. 3) to a toothed sector 343, which is also pivoted on the pin 339. The spring 342 provides two different stable positions between the toothed sector 343 and the lever 338. The sector 343 and the lever 338 338 are provided with shoulders 340 and 345 respectively and with a pin 349, and a spring 342 alternately holds the shoulders 340 and 345 against the pin 349. In this manner every displacement of the pin 327 in the forward or backward direction causes a corresponding clockwise or counterclockwise rotation of the sector 343. The fulcrum 327 is slidable in a slot 344 (FIG. 2) in the plate 341, which is suitably profiled to permit the various rotations of the lever 338.

A compensating spring 346 (FIG. 3), applied to one end 347 of the intermediate lever 338, is guided by a pulley 348 to the fixed stop 337 and respectively assists or hinders the action of the drive spring 336 when the latter acts on the selector lever 313 by the shorter arm or by the longer arm respectively, as will be described later on.

Figure 5:
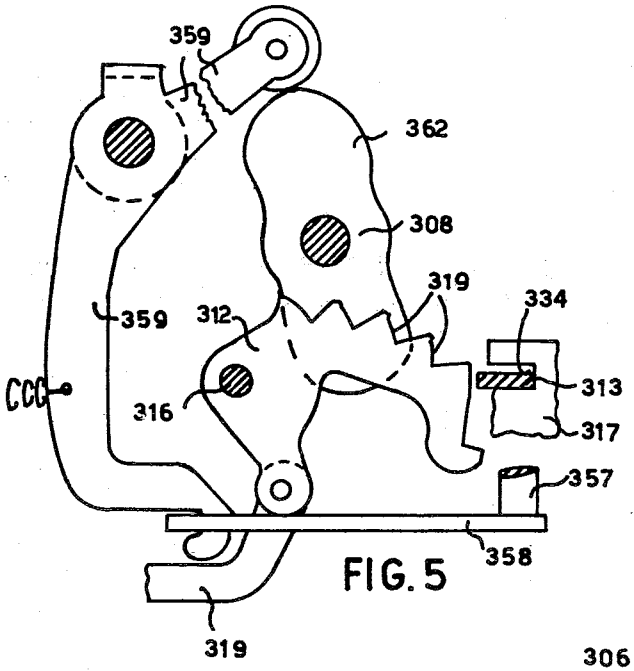
FIG. 5 is a partial longitudinal view of some details of FIG. 4.

A control member 351 releases the selector lever 313 for its operation by the drive spring 336, and comprises a forked member adapted to act on parts of the lever 313 which lie opposite the output zone 327. The forked member 351 is rotatable by means of its pin 352 (FIG. 2) in a seat 353 in the support 317 and comprises two posts 354 and 356 adapted to cooperate with the lever 313. The forked member 351 is connected by means of a post 357 and a connecting rod 358 to a cam follower lever 359 (FIG. 5) adapted to cooperate with a cyclic resetting or cam member 362 through the action of a spring 361. The cam 362 is fixed on the shaft 308 and is adapted to return the selector lever 313 (FIG. 3) to its position of rest against the action of the drive spring 336 on completion of the typing of the selected character.

The line selection device 131 (FIG. 1) includes a second selector lever 371 which is pivoted on a pin or fulcrum 372 (FIG. 4) of a movable support 373, and is adapted to be secured by a stop member 374 consisting of another flight of steps 388 comprising a series of five stops adapted to position the row of characters on the head 128 (FIG. 1) along a second coordinate.

The movable support 373 is provided with an operating slot 376 (FIG. 4) adapted to receive a pin 377 on the drive or forked member 351, and with a second slot 378 adapted to receive a pin 379 of the forked member 351.

The second selector lever 371 is held fast by its shoulder 381 against the pin 377 through the action of a spring 382 (FIG. 1), which constantly holds a fin 383 of a toothed sector 142 against a pin 386 of the lever 371.

The forked member 351 (FIG. 4) controls the lever 371 in two ways by means of the pin 377 when it is operated. On the one hand, the release of the shoulder 381 permits its negative rotation through the action of the spring 382 until it comes to bear against one of the stops 388, and on the other hand the positive action on the slot 376 in the movable support 373 moves the fulcrum 372 of the lever 371 by a constant quantity forward against the action of the same spring 382 (FIG. 1). In this way the selection of each row of characters on the head 128 is the result of the combined displacement of the lever 371 by the constant quantity as the result of the action of the support 37, and of the variable quantity determined by the stop member positioned, through the action of the spring 382.

The stop member 374 is pivoted on a pin 387 on the support 317 and is connected to the tie rod 137, while the five steps of the flight of steps 388 (FIG. 4) are adapted to hold a pin 389 of the selector lever 371 in the five selection positions for one of the five rows of characters on the head 128 (FIG. 1).

The toothed sector 142 is always in engagement with a second toothed sector 143 adapted to turn on the support 144, and by means of a connecting rod 146 the sector 143 is connected to a housing 147 in which the head 128 is adapted to turn and which can be variably tilted. The head 128 is disposed vertically in relation to the platen 129 and is connected by means of a shaft 391 to a pinion 392 in constant mesh with the toothed sector 343 of the column selection device 132. In its position of rest the head 128 is positioned in such a manner that the second row of characters faces the writing point. This permits on the one hand good visibility of the writing point, and on the other hand maximum displacement of three rows facing the writing point, thus limiting the acceleration of the moving mass.

Figure 6:
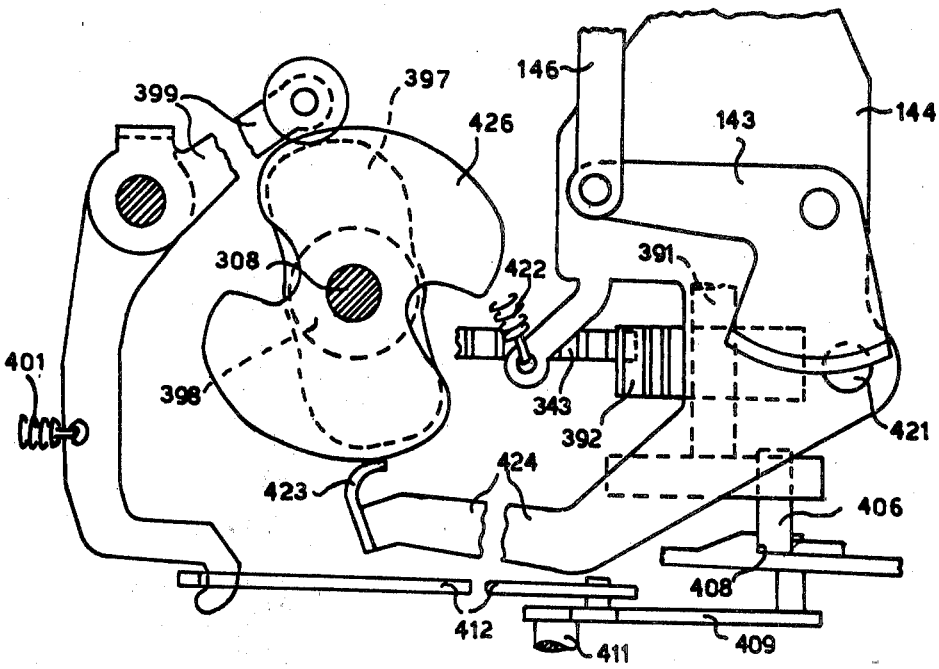
FIG. 6 is a partial longitudinal view of some details of FIG. 3.

The shift mechanism 303 (FIG. 3) comprises a member 396 kinematically connected to the head 128 (FIG. 1) and fastened to the shaft 391 and to the pinion 392, and a cyclically operated drive mechanism comprising a cam 397 (FIG. 3) rotated for a cycle of 180° by the drive shaft 307 by means of a clutch 398 and a cam follower lever 399 adapted to cooperate with the cam 397 through the action of a spring 401 (FIG. 6). A second member 402 (FIG. 3) is positioned by the cam 397 between one of two stable positions outside the trajectory of the first member under the action of the selector lever 313. In its movement from one of these two positions to the other, the member 402 moves in a zone in which it engages the member 396 and displaces the toothed sector 343 in relation to the intermediate lever 338. Through this rotation the head 128 (FIG. 1) is turned 180° so as to bring alternately in front of the platen 129, for the purpose of typing, the nine columns of "lower case" and "upper case" characters.

In particular, the first member 396 (FIG. 3) comprises a C-shaped rocking lever having two shoulders 403 and 404 on the arms of the C, and two inclined planes 413 and 414 disposed opposite the shoulders 403 and 404 and adapted to cooperate with a fin 406 on the second member 402. More particularly, the member 402 comprises a rectilinear sliding rod which through the action of a spring 407 is guided and held against two fixed shoulders 408 and which is connected to an L-shaped lever 409 adapted to turn on a pin 411 and in turn connected to a tie rod 412 of the cam follower lever 399. When the sliding rod 402 (FIG. 3) engages the rocking lever 396, the pinion 392 displaces the sector 343 against the action of the spring 342 from one of the two stable positions defined by the shoulder 340 or 345, at least to a point beyond the unstable position determined by the spring 342. At this point the fin 406 comes out of engagement with the rocking lever 396, and the spring 342 causes the sector 343 to continue to move until it is halted by the shoulder 340 or 345 against the pin 349.

The support 144 (FIG. 6) is adapted to turn about an axis 421 for the purpose of bringing the head 128 (FIG. 1) to strike the selected character against the platen 129. A spring 422 normally holds the support 144 turned in the counterclockwise direction and held by a fin 423 of an arm 424 against the profile of a striking cam 26, as described in the previously mentioned U.S. Pat. No. 3,957,149, which cam is rotated on the cyclically acting shaft 308.

The selector system operates in the following manner.

When any key 11 (FIG. 7) is depressed, the corresponding key carrier lever 12 is rotated and lowered against the action of the respective leaf spring 22. The fin 28 engages the shoulder 27, thus causing the lowering of the respective positioner 26, which frees the shoulder 29 from the fixed stop 31. The spring 36 pushed the positioner 26 forwards, thus causing its end 37 to turn the roof-shaped member 38 in the clockwise direction and the first release lever 73 in the counterclockwise direction against the action of the spring 76, thus freeing the second release lever 81. The positioning spring 92 turns the lever 87 in the counterclockwise direction, and this lever, through the universal bar 42, pushes back the positioner 26 against the action of the spring 36 until it reaches the working position shown in dash-dot lines, in which the positioner is held supported in the upward direction by the support 54 and, through the medium of the shoulder 27, by the stop 31.

During this displacement the tie rod 93 closes the starting clutch 306 (FIG. 4) and a kinematic system which is not shown in the drawings, but which is similar to that described in U.S. Pat. No. 4,027,763, causes the probe members 47, 48, and 49 (FIG. 7) to turn as far as their stopping points determined by the respective stop 43, 44, 46 at different heights of the positioner, which is in its working position in accordance with the combination corresponding to the key 11 which has been depressed.

The rotation of the probe members 47, 48, and 49 by means of the tie rods 137, 138, and 139 brings about a corresponding rotation of the respective stop members 374, 311, and 312 so as to bring a determined step in position in front of the respective selector levers 371 and 313.

On the closing of the clutch 306 (FIG. 4), the shaft 308 starts to turn with the cam 362 and allows the spring 361 (FIG. 5) to turn the cam follower lever 359 in the clockwise direction. The lever 359 then pulls the connecting rod 358, which by means of the post 357 causes the control member 351 (FIG. 4) to turn in the counterclockwise direction. The posts 354 and 356 free the first selector lever 313, and the pin 377 frees the second shoulder 381 of the selector lever 371.

Figure 3:
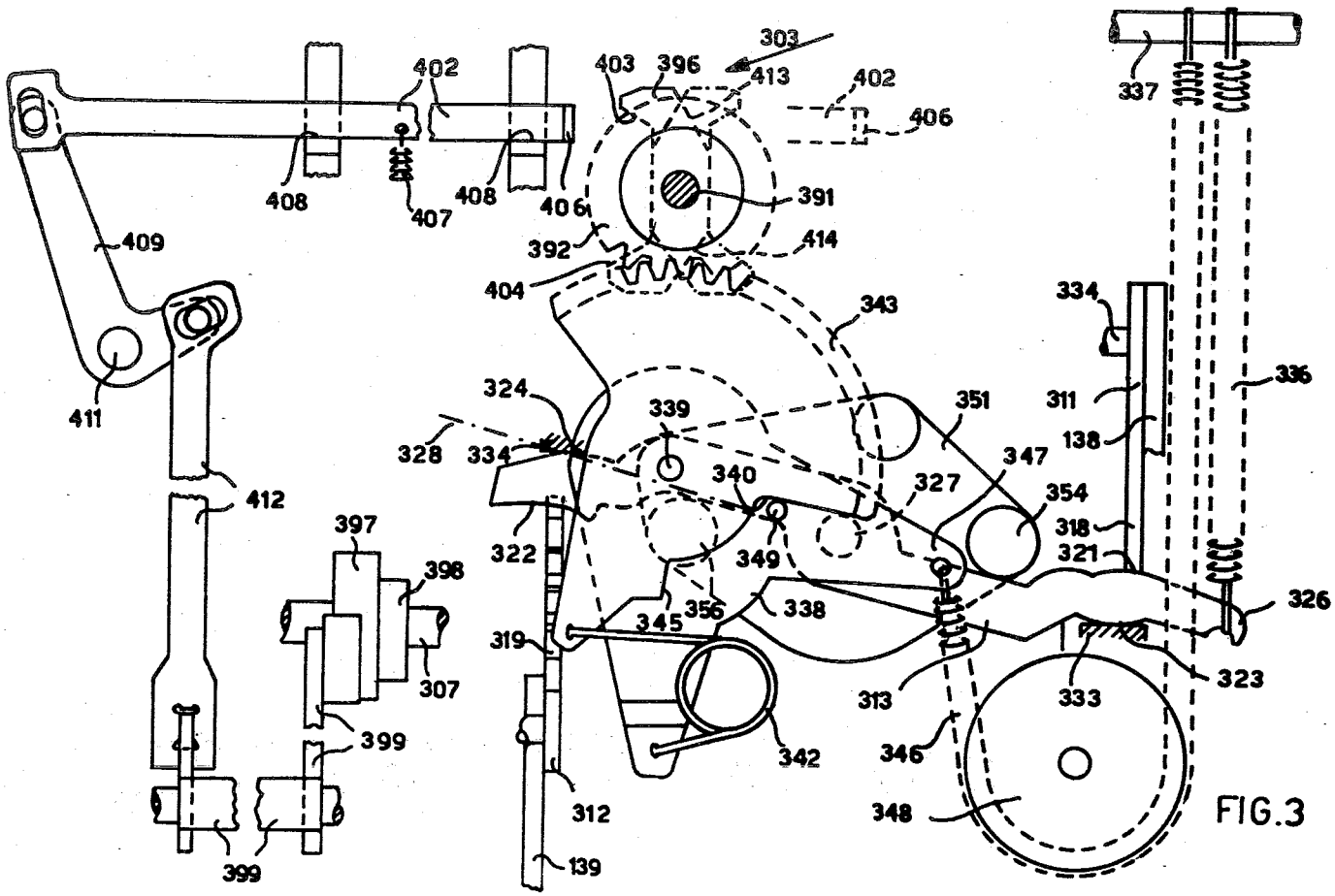
FIG. 3 is a partial plan view of some details of the selector system according to the invention.

The selector lever 313 (FIG. 3) turns in the counterclockwise direction through the action of the drive spring 336 until it comes to rest with the shoulders against the flights of steps 318 and 319 of the stop members 311 and 312 positioned by the respective tie rods 138 and 139. Through the fulcrum 327 (FIG. 2), which is slidable in the slot 344 in the plate 341, the selector lever 313 turns the intermediate lever 338 and thus the toothed sector 343 about the fixed pin 339 (FIG. 3). The sector 343 in turn rotates the pinion 392 and, through the shaft 391, the head 128 (FIG. 1), so as to position the selected column on the head 128 in front of the platen 129.

FIG. 9 shows diagrammatically, in broken lines and in dash-dot lines, the end positions of the selector lever 313, and 330 indicates the trajectory, with the nine positions of the fulcrum 327 for the selection of the columns on the head 128. The table in FIG. 10 shows the positions of the toothed sector 343 in relation to the four different angular positions of the stops 311 and 312. From FIGS. 9 and 10 it can be seen that if the stops 311 and 312 remain in the position of rest, that is to say each of them with the first step in a position corresponding to the shoulder 321, 322 of the selector lever 313, the drive spring 336 will not move the lever 313 and the toothed sector 343 does not rotate, so that the selection is 0 or the central column remains positioned in front of the platen 129 (FIG. 1).

If the stop 311 (FIGS. 9 and 10) remains with the first step facing the shoulder 321 while the stop 312 is rotated one, two, three, or four angular steps, the stop 312 will have the second, third, fourth, or fifth step facing the respective shoulder 322. The drive spring 336 turns the lever 313 in the counterclockwise direction with its fulcrum at 321, and turns the toothed sector 343 in the clockwise direction, thus effecting the selections of the first four columns on the right on the head. In this case, the compensating spring 346 assists the action of the drive spring 336 acting on the selector lever 313 with the short lever arm because of the short distance between the spring 336 and the fulcrum 321.

If on the other hand the stop 312 is held fast with the first step in the position corresponding to the shoulder 322 and the stop 311 is turned so as to place the second, third, or fourth step in a position facing the shoulder 321, the drive spring 336 will turn the lever 313 in the clockwise direction with its fulcrum at 322 and will turn the sector 343 in the counterclockwise direction, thus bringing about the selection of the first four columns on the left on the head. In this second case the compensating spring 346 counteracts the action of the drive spring 336, which is now working with a long lever arm because of the long distance between the spring 336 and the fulcrum 322.

For the selection of the rows, the rotation of the pin 377, resulting in its sliding in the slot 376 which is of appropriate profile, moves back the fulcrum 372 (upwards in FIG. 4) by a determined constant quantity. At the same time the spring 382 (FIG. 1), pushing the fin 383 of the toothed sector 142 against the pin 386, turns the selector lever 371 in the clockwise direction until it is stopped with the pin 389 (FIG. 4) against the step 388 of the stop 374 positioned by the tie rod 137. The toothed sector 142 turns the sector 143 (FIG. 1), which with the aid of the connecting rod 146 and the housing 147 positions the selected row on the head 128 in front of the platen 129. The arrangement of the various parts in relation to one another is such that the backward displacement of the fulcrum 372 is effected against the action of the spring 382 and in such a manner as to turn forwards the housing 147 (FIG. 1) of the head 128 for the selection of the first row of characters on the head.

FIG. 8 shows diagrammatically the various positions of the selector lever 371 for the five rows on the head 128. In particular, if the stop 374 (FIG. 4) remains in the position shown in FIG. 4, with the first step 388 in a position corresponding to the pin 389, the displacement of the fulcrum 372 turns the sector 142 (FIG. 1) in the counterclockwise direction for the selection 0 or the positioning of the first row of characters. If the stop 374 (FIG. 4) is on the other hand turned so that the second step 388 is in a position corresponding to the pin 389, the spring 382 tends to select the second row, but the displacement of the fulcrum 372 fully compensates for the displacement of the pin 389, so that the sector 142 remains stationary and selection 1 is obtained, that is to say the second row of characters remains in position facing the platen 129 (FIG. 1). If the stop 374 (FIG. 4) is finally rotated so that the third or fourth step 388 comes to lie opposite the pin 389, the displacement of the fulcrum 372 will partly compensate for the displacement of the pin 389, so that the spring 382 (FIG. 1) turns the sector 142 two or three steps, thus obtaining selection 2 or 3, that is to say the positioning of the third or fourth row of characters on the head 128. By means of this combined movement the maximum displacement of the head amounts to three rows and the acceleration forces required can be kept low, as can be seen from the space (s)/time (t) diagram shown in FIG. 11 in connection with the selection of the four different rows of characters.

The striking cam 426 (FIG. 6) causes the character selected on the head 128 (FIG. 1) to strike, on completion of each row and column selection cycle, against the platen 129 in the manner described in the previously mentioned U.S. Pat. No. 3,957,149. The cam 362 (FIG. 4) in turn brings back to the position of rest the control member 351 together with the selector levers 313 and 371, while the other members of the kinematic system are returned to the position of rest and the clutch 306 is opened.

The shift mechanism 303 (FIG. 7) operates in the following manner.

When the corresponding shift key on the keyboard 304 (FIG. 7) is depressed, the clutch 398 (FIG. 3) is closed, the cam 397 starts to turn, and through the action of the spring 401 (FIG. 6) the cam follower lever 399 is turned in the clockwise direction. By means of the tie rod 412 (FIG. 3) the L-shaped lever 409 then causes the sliding rod 402 to slide to the right in FIG. 3. The fin 406 engages the shoulder 403 and brings about a rotation through 180° of the rocking lever 396 together with the pinion 392, the shaft 391, and the head 128 (FIG. 1) so as to cause the group of "upper case" characters to face the platen 129. Together with the pinion 392, the toothed sector 343 (FIG. 3) turns until it is stopped in a position determined by the bistable spring 342.

After a rotation of 90°, the clutch 398 opens, terminating the rotation of the cam 397, so that the fin 406 remains in a zone outside the trajectory of the rocking lever 396, as shown in broken lines in FIG. 3.

When the shift key on the keyboard 304 (FIG. 7) is now raised, the clutch 398 (FIG. 3) is closed and the cam 397 turns the cam follower lever 399 in the counterclockwise direction, and with the aid of the tie rod 412 of the L-shaped lever 409 the lever 399 causes the sliding rod 402 to slide to the left in FIG. 3. The fin 406 then engages with the shoulder 404 and turns the rocking lever 396 180° with the pinion 392, the sector 343, the shaft 391, and the head 128 (FIG. 1), thus placing the group of "lower case" characters once again in front of the platen 129.

If the operator attempts to turn the head 128 manually, this is made possible in the direction of rotation which tends to displace the toothed sector 343 in its other stable position in relation to the lever 328, against the action of the spring 342. If the rotation of the head should happen to exceed 90°, the head will be 180° out of phase in relation to its normal position. In other words, instead of the "lower case" zone or "upper case" zone, the groups of "upper case" or "lower case" characters respectively will face the platen 129, without the respective shift key being operated. However, the mechanism 303 is able to correct automatically the position of the head 128 to coincide with the position of the shift key the next time that the latter is operated. For this purpose the rocking lever 396 (FIG. 3) has two inclined planes 413 and 414 opposite the shoulders 403 and 404. If the operator has turned the head 128 (FIG. 1) manually, the rocking lever 396 (FIG. 3) presents facing the fin 406 one of the two inclined planes 413 or 414 instead of the shoulders 403 and 404. When the shift key is depressed, the cam 397 causes the sliding rod 402 to slide to the right, as described above. With this arrangement, the fin 406 encounters the inclined plane 413 or 414, slides over it, and over the rocking lever 396, overcoming the action of the respective spring 407, without succeeding in turning the lever 396, and resumes the position shown in broken lines in FIG. 3. The shoulder 403 or 404 is now facing the fin 406. When the shift key is then raised as described above, the fin 406 engages with the shoulder 403 or 404 and turns the pinion 392 together with the head 128 (FIG. 1). By this operation the position of the head 128 is brought back into phase with the shift mechanism 303.

It is understood that various modifications, improvements, and additions of parts may be made to the devices described above without departing from the scope of the invention.

I claim:

1. In a selector system for a type carrier of a typewriter comprising a support, an intermediate lever pivoted on the support and operatively connected with the type carrier for the selection of a character of the type carrier and two groups of stop members selectively settable in dependence on the character to be selected, the combination comprising:

a substantially rectilinear selector lever having a longitudinal axis and including a central zone and two stop and fulcrum shoulders lying on opposite zones of said longitudinal axis with respect to said central zone, wherein each of said two shoulders is cooperative with an associated group of said two groups of settable stop members and wherein a set stop member of said group lies at a different distance from the associated shoulder;

means pivoting the central zone of said selector lever on said intermediate lever for causing the typing member to select a different character in response to a variable displacement of said central zone;

driving spring means for rotating said selector lever with respect to said intermediate lever according to a predetermined sense of rotation;

a forked member having two arms substantially symmetrical with respect to the central zone of the selector lever and operable to hold the selector lever in a rest position against the action of said driving spring means;

means for releasing said forked member for causing the selector lever to be operated by said driving spring means up to the arrest of one of said stop and fulcrum shoulders against a set stop member, with following displacement of said central zone and selection of the desired character, wherein a set stop member of one group of stop members causes a rotation of the intermediate lever along one sense of rotation and the set stop member of the other group of stop members causes a rotation of the intermediate lever along another sense of rotation opposed to said one sense of rotation; and means restoring the forked member for causing the selector lever and the intermediate lever to return to said rest position on completion of the typing of the selected character.

2. A system as claimed in claim 1, wherein the forked member comprises a cyclic resetting member which returns the selector lever to its position of rest against the action of the driving spring means on completion of the typing of the selected character.

3. A selector system according to claim 1, wherein each of said two groups of stop members comprises a stop lever pivotable on the support, each of said stop members comprises a flight of steps of different heights of said stop lever and each of flight of steps is positionable in front of the associated shoulder in response to a corresponding angular position of said stop lever.

4. A selector system according to claim 3, further comprising a third group of stop members of a third step lever which is selectively positionable and a second selector lever operated by a spring, said second selector lever positions the type carrier along another coordinate, and wherein the forked member releases said second lever to be arrested by a stop of said third group in order to position the type carrier along said other coordinate.

5. A system as claimed in claim 4, wherein the second selector lever is pivoted on a movable support provided with a driving slot, and wherein said fork member comprises a pin engaging with the second selector lever and with the driving slot of the said movable support for the purpose of displacing the fulcrum of the second selector lever by a constant quantity against the action of the corresponding spring.

6. A selector system according to claim 1, wherein the typewriter comprises a keyboard comprising a series of keys, a series of positioners, each associated to a corresponding key of said series, and three code bars associated with the three groups of stop members, wherein each positioner comprises codified steps and wherein the three code bars sense the steps of said codified steps of the positioner selected by the action of the key for positioning the flight steps of the stop levers associated with the operated key.

7. A selector system according to claim 6, wherein the code bars angularly position the stop members in response to the sensing of the codified steps of the selected positioner.

8. A selector system according to claim 1, wherein said driving spring means comprise a driving spring operating at an end of the selector lever and a compensated spring operating on said intermediate lever, wherein one of said two stop and fulcrum shoulders and one associated group of stop members are located between the central zone and the end of the selector lever so that said driving spring operates on said selector lever with a shorter arm when a step member of said one group is set and with a longer arm when one step member of the other group of step members is set, and wherein said compensating spring respectively assists or hinders the action of the driving spring when said driving spring operates on the selector lever with the shorter arm or with the longer arm respectively.

9. A selector system according to claim 1, comprising a pair of fixed stops disposed, in relation to the stop members of the two groups, in order to avoid rebound on the stop member acting as fulcrum for the selector lever.

10. A typewriter having a type carrier head whose characters are distributed in two different areas, a selector with an output member movable for the selection of the character to be typed, in one of the two areas, and an intermediate member which permits two different arrangements of the head in relation to the said output member for the purpose of preparing one of the two areas for typing, comprising a first member kinematically connected to the head, a cyclically operated driven mechanism, and a second member which is moved by the said mechanism between one of two zones outside the trajectory of the said first member and a zone in which it engages the said first member and in which the second member, in its movement from one of the two zones to the other, displaces the intermediate member in relation to the output member of the selector and prepares for typing the other of the two areas of characters on the head, where the first member comprises a rocking lever provided with at least two shoulders, and wherein the second member engages these shoulders for the rotation of the rocking lever and the selection of the other area when this second member moves in the zone of engagement with the first member.

11. A typewriter as claimed in claim 10, wherein the rocking lever is substantially C-shaped and is provided with only two shoulders on the arms of the C and with two inclined planes adjacent to the said shoulders, and wherein the second member turns this first member only when the second member engages one of the two shoulders.

12. A typewriter as claimed in claim 11, wherein the second member is supported elastically on a guide for its movement between the outer zones and the zone of engagement with the aforementioned first member, in such a manner as to engage positively one of the shoulders for the rotational driving of the rocking lever and to be disengaged from one of the inclined planes for non-operative driving on the said lever.

13. A typewriter as claimed in claim 10 wherein the head is provided with a toothed pinion for the selection of characters, and wherein the output member of the selector positions a toothed sector in engagement with this pinion.

14. A typewriter as claimed in claim 13, wherein said first member is fastened to the said toothed pinion.

* * * * *